United States Patent [19]

Lauer et al.

[11] Patent Number: 4,609,120

[45] Date of Patent: Sep. 2, 1986

[54] PLASTIC CONTAINER AND HANDLING ASSEMBLY

[75] Inventors: Leonard Lauer, New York; Susan Spiegel, Old Brookville, both of N.Y.

[73] Assignee: United Utensils Corporation, Port Washington, N.Y.

[21] Appl. No.: 748,769

[22] Filed: Jun. 25, 1985

[51] Int. Cl.[4] ..... B65D 1/46

[52] U.S. Cl. ..... 220/69; 220/5 R; 220/71

[58] Field of Search ..... 220/69, 85 K, 71, 5 R

[56] References Cited

U.S. PATENT DOCUMENTS

| | | | |
|---|---|---|---|
| 1,852,281 | 4/1932 | Bell | 220/5 R |
| 2,481,015 | 9/1949 | Ingersoll | 220/69 |
| 3,955,705 | 5/1976 | Dubois et al. | 220/67 |
| 4,022,345 | 5/1977 | Butz | 220/71 |
| 4,088,239 | 5/1978 | Uhlig | 220/5 R |
| 4,203,526 | 5/1980 | Stoll, III | 220/71 |
| 4,294,374 | 10/1981 | Ames | 220/71 |
| 4,549,672 | 10/1985 | Rinkewich | 220/71 X |

*Primary Examiner*—Steven M. Pollard

*Attorney, Agent, or Firm*—Louis H. Reens

[57] ABSTRACT

A plastic container and handling assembly are described to enable a plastic container to store heavy bulk materials while handling the container for transport or other purposes. A groove is formed in the region of the container for which support is desired and a metal bar of corresponding shape and size is placed in the groove. A metal support having a plate in abutment with the metal bar and overlying it as well as adjoining regions of the plastic container is welded at spaced apart places to the bar without causing melting of the plastic container to thus affix the support to the container. Several embodiments are described.

12 Claims, 11 Drawing Figures

FIG. 5
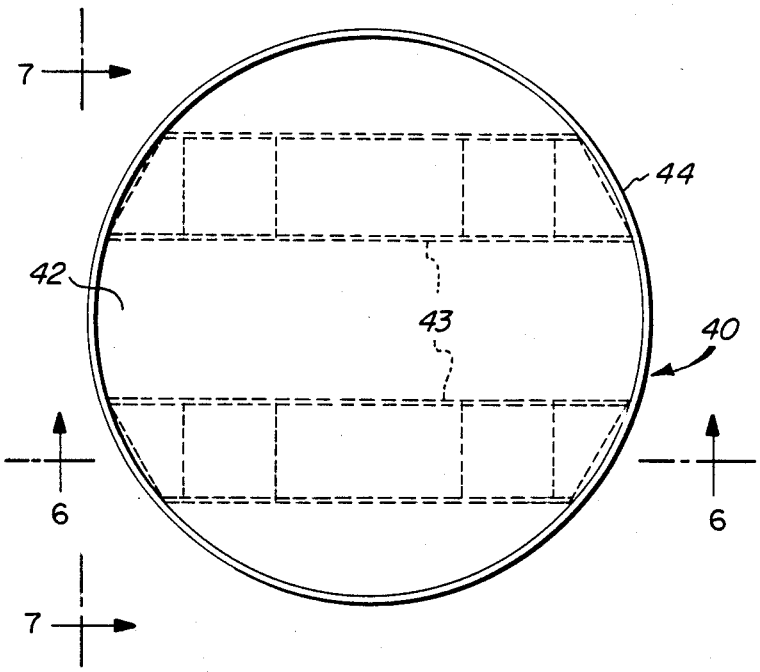
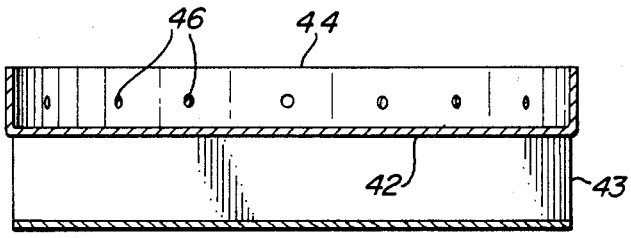
FIG. 6
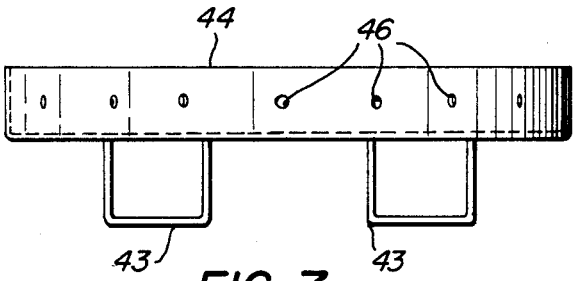
FIG. 7
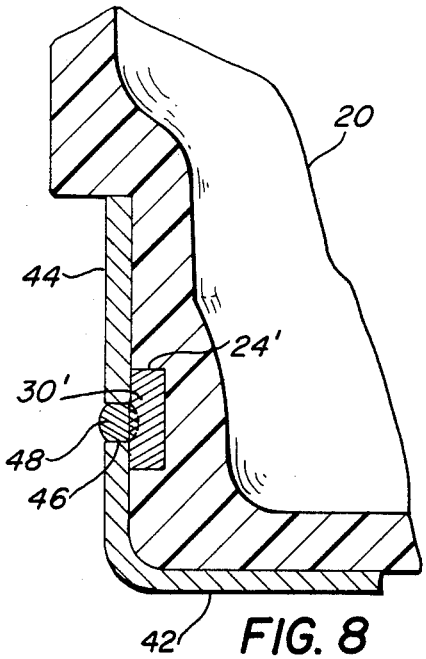
FIG. 8

PLASTIC CONTAINER AND HANDLING ASSEMBLY

FIELD OF THE INVENTION

This invention generally relates to a handling assembly for a plastic container and more specifically to a rotationally molded plastic vat assembly.

BACKGROUND OF THE INVENTION

Devices for attachment to plastic vats, drums or the like have been proposed in the art. Such devices are needed to strengthen the portions of the plastic containers and facilitate their handling. One such device is described in U.S. Pat. No. 4,022,345 to Butz and discloses a plastic drum with a metal handling ring for lifting and manipulation by fork lifts and the like. The drum has an annular recess into which a ring of metal is snapped.

U.S. Pat. No. 4,294,374 to Ames discloses a semicircular recess in a bulk material storing plastic drum. A correspondingly shaped projection of a split metal collar fits into the recess. Such arrangement is described for use on the top or the bottom of the plastic drum.

Other attaching devices for plastic containers are described in U.S. Pat. Nos. 4,088,239, 4,203,526 and 3,955,705.

Although these handling devices are useful, they do not necessarily enable a handling of a heavy vat and its contents or provide adequate reinforcement of the plastic vat. Plastic vats, particularly those made of rotationally molded polyethylene, are desired in many bulk material handling applications.

SUMMARY OF THE INVENTION

With a handling assembly in accordance with the invention a plastic container can be conveniently provided with a sturdy reinforcing manipulation device that enables a safe and reliable handling of bulk materials.

As described herein for one form of the invention a plastic container is formed with a groove at a container region for which handling support is desired. A metal bar that is sized to snugly fit inside the groove is placed along an insertion direction in the groove whose wall keeps the metal bar in position on the container. A metal support is formed which embraces the container region and is in abutment with and overlies the metal bar so as to prevent the latter from escaping from the groove in the direction of insertion. The metal support is then affixed to the bar such as by use of welds to firmly attach the metal support to the plastic container. The metal support includes suitable brackets or devices by which the container can be handled such as by fork-lifts.

Welding of the metal support to the metal bar preferably is done with spaced apart welds such as with plug welds that require only local heating without causing a melting of the plastic container.

As described with respect to one container and handling assembly in accordance with the invention the container is rotationally molded from a polyethylene powder and during this molding a groove is formed around the perimeter of the container region for which handling support is desired. A solid metal bar, whose crossectional shape corresponds to that of the groove is then placed in the groove. The metal bar snugly fits inside the groove which holds it in position on the container with a surface of the bar generally flush with the side wall of the container.

A metal support is applied to the container region. The support has a plate that encircles the container at the side wall in abutment with the exposed flush fitting metal bar surface and the adjoining container region. The metal support is further provided with suitable attachments for engagement by a transporter such as a fork lift. The support plate is welded to the metal bar to provide a rigid, well attached, support and handling device for the plastic container.

The groove and metal bar may have different crossections; however, a rectangular shape is particularly effective to provide the desired attachment. With a container and handling assembly in accordance with the invention heavy bulk materials can be stored and transported in a processing plant.

The metal support can be formed with a flat platform on which the bottom of the container is seated while the support plate, which extends up from the platform, encircles the lower end of the side of the container. Suitable palletlike recesses are provided below the platform to receive the fork of a fork lift.

As described herein for an alternate form of a container and handling assembly in accordance with the invention a vat is rotationally molded with dove-tail shaped grooves in the bottom wall. The grooves extend from a side of the container so that correspondingly shaped and snugly fitting solid metal bars can be slid into the grooves from the side for retention and with a surface of the bars exposed. A metal support having a flat platform and an upwardly extending and container-encircling wall is affixed to the metal bars. The attachment to the metal bars may be done with plug welds made through pre-drilled platform holes that are aligned with the bars.

With a plastic container and handling assembly in accordance with the invention a rugged reinforced container is provided suitable for handling heavy bulk materials.

It is, therefore, an object of the invention to provide a handling assembly for a plastic container. It is a further object of the invention to provide a method for attaching a handling assembly to a plastic container. It is still further an object of the invention to provide a plastic container and handling assembly whereby heavy bulk materials can be transported.

These and other advantages and objects of the invention can be understood from the following detailed description of the invention as described in conjunction with the drawings.

BRIEF DESCRIPTION OF DRAWINGS

FIG. 5 is a top plan view of the metal support shown in FIG. 1;

FIG. 6 is a section view taken along the line 6—6 in FIG. 5 of the metal support;

FIG. 7 is a section view taken along the line 7—7 in FIG. 5 of the metal support;

FIG. 8 is an enlarged partial section view as FIG. 4 of an assembled bottom container region for which support is desired but with a rectangular crossection for the metal bar 2 of FIG. 3;

DETAILED DESCRIPTION OF THE DRAWINGS

Figure 1:
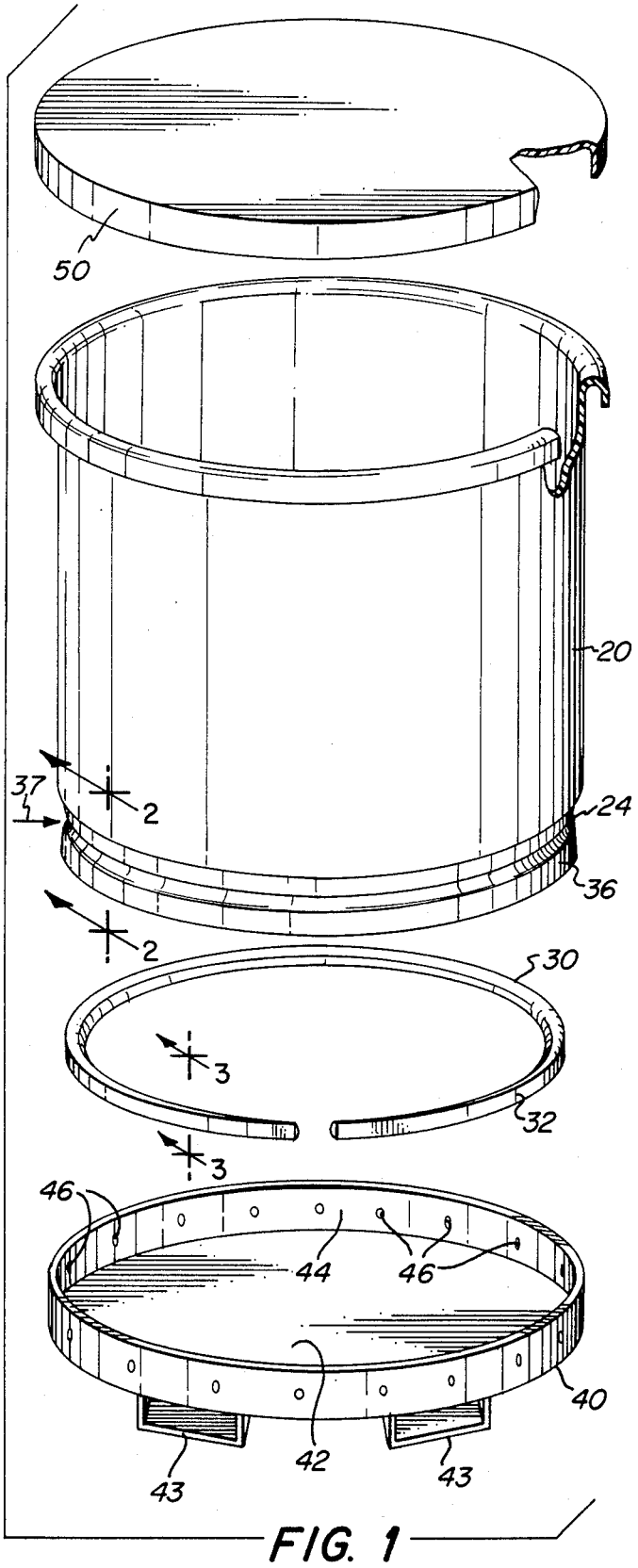
FIG. 1 is an exploded perspective view of a plastic container and support assembly in accordance with the invention.
Figure 2:
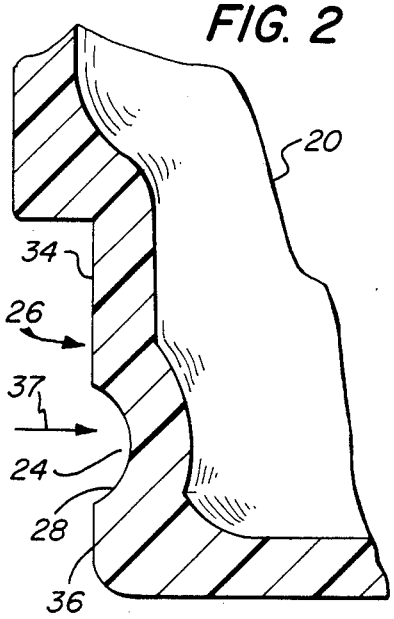
FIG. 2 is an enlarged partial sectional view taken along the line 2—2 in FIG. 1 of a bottom container region for which support is desired.
Figure 3:
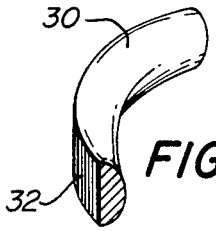
FIG. 3 is a partial perspective crossectional view taken along the line 3—3 in FIG. 1 of a metal bar used in the support assembly of FIG. 1.

With reference to FIGS. 1-7 a plastic container 20 and a handling and support assembly 22 in accordance with the invention is shown prior to and after assembly. The plastic container 20 is made with a rotational molding process, such as described in the U.S. Pat. No. 3,134,140 to Knowles whereby a plastic powder, such as polyethylene, is inserted in a mold. The mold is heated and rotated around different axes so as to tumble the powder and gradually build up the plastic container. Such container may of course be used for many purposes and frequently requires to be filled with bulk material that needs to be transported from one place to another.

Plastic is a desirable material for carrying containers but may be too weak to accommodate handling when filled with heavy bulk material. In accordance with the invention container 20 is formed with a circumferential externally accessible groove 24 that encircles the bottom container region 26 for which support and reinforcement is desired. Groove 24 has a curved back wall 28 but may have a rectangular crossection as illustrated at 30' in FIG. 8. Groove 24 has sufficient depth to retain and prevent escape of a metal bar, such as 30, under full load conditions.

Figure 4:
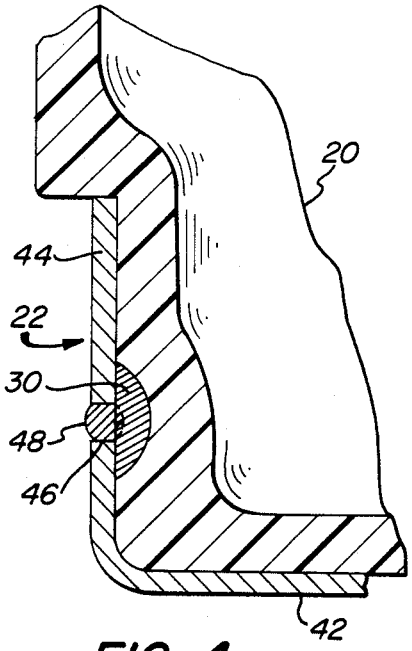
FIG. 4 is an enlarged partial section view of an assembled bottom container region for which support is desired.

Bar 30 is made of solid metal with a crossection and size that correspond to that of groove 24 so as to snugly fit inside it. Bar 30 is further so sized that its exposed outer surface 32 will align substantially flush with the side 34 of container region 26 as shown in FIG. 4.

Bar 30 is arranged in the form of a split ring which can be sufficiently expanded to fit over the bottom edge 36 to enter groove 24 along an insertion direction as shown by arrow 37. Bar 30 has a length that enables it to encircle the bottom region 26 while emplaced in groove 24.

A metal support 40 is provided so as to embrace the bar 30 and container region 26. Support 40 includes a platform 42 sized to provide a bottom reinforcement for container 20 and has a peripheral plate 44 sized to snugly encircle side 34 and bar 30 at the bottom container region 26. Platform 42 has fork lift channels 43 to facilitate handling of container 20. Plate 44 is in abutment with bar 30 and overlies adjoining regions of container 20. Plate 44 is an integral part of support 40 and may be formed of a metal strip that was previously welded to platform 42.

Plate 44 is affixed to bar 30 at various places around the periphery of container region 26. As a result a strong support assembly 22 is provided for container region 26 that enables a full container 20 to be handled, such as by a fork lift without breakage.

Affixation of plate 44 to bar 30 may be done in various ways but preferably is obtained with spaced-apart welds. Plate 44, therefore, is provided with a plurality of holes 46 that are located so as to align with surface 32 of bar 30. Plug welds such as 48 in FIG. 4 are then made at holes 46 to firmly affix plate 44 to bar 30. The heat generated with such spaced apart welds can be conducted away sufficiently fast so as to avoid plastic melting at the weld sites.

Figure 9:
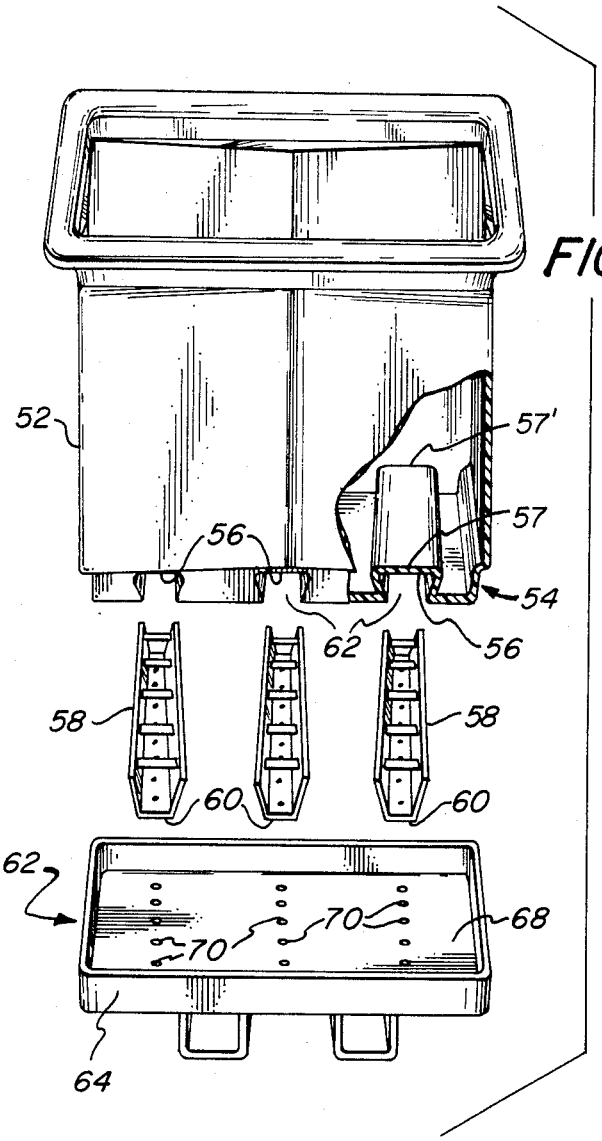
FIG. 9 is an exploded view of a alternate form of a plastic container and support assembly in accordance with the invention.
Figure 11:
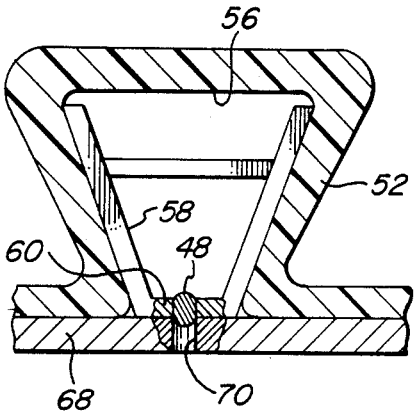
FIG. 11 is an enlarged sectional view of the portion encircled by line 11 in FIG. 10.
Figure 10:
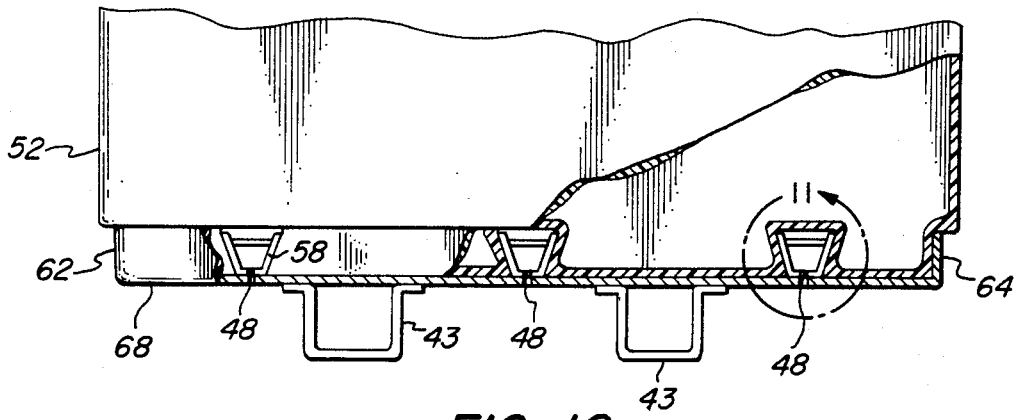
FIG. 10 is a partial view in elevation and in partial section of the assembled plastic container and support shown in FIG. 9.

In the embodiment of FIGS. 1-7 a cylindrical container 20 is illustrated with a cover 50. Differently shaped containers can be used and provided as illustrated in the embodiment shown in FIGS. 9-11. A rectangular crossection container 52 is shown which, like container 20 in FIG. 1, may be formed by a rotational molding process. The bottom region 54 of container 52 is provided with straight dove-tailed shaped externally exposed grooves 56. The grooves 56 extend from side 57 to side 57' of container 52.

Correspondingly shaped metal channel bars 58 that snugly fit inside grooves 56 are placed therein with an outer solid wall 60 exposed through the openings 62 of grooves 56. When the channel bars 58 are placed inside grooves 56 the dovetailed inter-lock captures the bars 52 inside the grooves.

A rectangularly shaped support 62 having a correspondingly shaped upper plate 64 fits snugly around a lower end of sides 57 of container 52. Support 62 has a bottom support platform 68 with holes 70 in alignment with walls 60 of channel bars 58. When the support 62 is applied to container 52 the upper plate 64 prevents lateral escape from grooves 52. Formation of plug welds such as 48 at holes 70 affix the channel bars 58 to support platform 68. This results in a strong reinforcement of the plastic container 52 with an effective handling assembly.

Having thus described a container and handling assembly in accordance with the invention its advantages can be appreciated. Variations from the described embodiments can be made without departing from the scope of the invention as set forth by the following claims.

What is claimed is:

1. A handling assembly for a plastic container having a groove at a container region for which handling support is desired, comprising:

a metal bar sized to snugly fit along an insertion direction within the groove of the container, said groove having a wall which keeps the bar in position on the container;

metal support means embracingly supporting the container regional and in abutment with and overlying the metal bar so as to prevent escape along the insertion direction of the metal bar from the groove, said metal support means being further shaped to enable manipulation of the container; and means for affixing the metal support means to the metal bar;

whereby the plastic container can be physically manipulated through the metal support means.

2. The plastic container assembly as claimed in claim 1 wherein the affixing means comprises a plurality of spaced-apart welds.

3. The plastic container handling assembly as claimed in claim 2 wherein the metal bar has an external flat surface that is substantially flush with the adjoining region of the plastic container and wherein the metal support means has a wall that abuts the adjoining region and the metal bar and is plug welded to the bar.

4. The plastic container handling assembly as claimed in claim 2 wherein the metal bar is solid metal with a rectangular crossectional shape and with the groove having a complementary shape as the bar so that the metal bar has a surface that is substantially flush with the adjoining external surface of the container.

5. The plastic container as claimed in claim 2 wherein the metal bar is solid and has a straight wall and a curved wall, with the groove being complementary shaped as the metal bar so as to enable its straight wall to fit substantially flush with the adjoining region of the plastic vat.

6. The plastic container handling assembly as claimed in claim 1 wherein said plastic container is provided with a plurality of said grooves, and a plurality of said metal bars being respectively placed in said grooves;

said metal support means including a plate which is shaped to abut exposed sides of the metal bars and the container region adjoining the metal bars.

7. The plastic container handling assembly as claimed in claim 6 wherein said plastic container has a plurality of said grooves formed in the bottom of the container and extending from one side of the container, said grooves forming a dove-tail shape oriented so as to retain metal bars placed therein, said metal bars being complementary shaped with the grooves so as to fit therein from said one container side;

said metal support means further including an encircling wall that abuts the side of the container and covers the groove ends at said one container side.

8. The plastic container handling assembly as claimed in claim 7 wherein said plate is plug welded to said metal bars.

9. The plastic container handling assembly as claimed in claim 1 wherein the plastic container has a bottom located circumferentially extending groove, and wherein the metal support means includes an encircling wall that extends around the groove in abutting contact with the metal bar and the adjoining container region, said affixing means comprising a welding of the wall to the metal bar.

10. The plastic container assembly as claimed in claim 9 wherein the wall is plug welded to the metal bar.

11. A plastic vat assembly comprising a rotationally molded plastic vat having a bottom located encircling rotationally molded groove and a substantially straight side wall adjoining the groove, a solid metal bar sized to snugly fit within the groove, said metal bar having a side wall that fits substantially flush with the side wall of the pastic vat, metal support means for embracingly supporting the vat, said metal support means including a wall that encircles and overlies the groove and is in abutment with the metal bar as well as a bottom region of the vat and means affixed to the latter wall to enable manipulation of the vat, said metal support means being affixed to the metal bar with a plurality of plug welds located around the plastic vat.

12. A method for reinforcing the bottom region of a rotationally molded plastic vat comprising the steps of:

rotationally molding a plastic vat with an externally accessible circumferential groove that surrounds the bottom region of the vat;

inserting in the groove a metal bar of complementary crossectional shape as that of the groove with the bar having an external surface that is essentially flush with the adjoining surface of the bottom region, embracing the bar and the adjoining bottom region with the metal cover so as to overlap the metal bar, and welding the metal cover at selected spots to the metal bar to form a reinforced bottom vat with a support assembly that is positively locked in place therewith.

* * * * *